US007568412B2

(12) United States Patent
Cummings

(10) Patent No.: US 7,568,412 B2
(45) **Date of Patent: *Aug. 4, 2009**

(54) METHOD FOR ORDER TRANSITION ON A PLUNGE SLITTER

(75) Inventor: James A. Cummings, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/850,171

(22) Filed: Sep. 5, 2007

(65) Prior Publication Data

US 2007/0295181 A1 Dec. 27, 2007

Related U.S. Application Data

(63) Continuation-in-part of application No. 11/243,279, filed on Oct. 4, 2005.

(51) Int. Cl.
*B26D 3/00* (2006.01)
*B26D 7/26* (2006.01)
*B31F 1/32* (2006.01)

(52) U.S. Cl. ..... 83/47; 83/425.4; 83/39; 83/42; 83/44; 83/45; 156/207

(58) Field of Classification Search ..... 83/13, 83/425, 102, 408, 42, 45, 47, 304, 425.1, 83/425.2, 425.4; 156/64, 210, 269, 271, 156/353, 207
See application file for complete search history.

(56) References Cited

U.S. PATENT DOCUMENTS

| | | | | |
|---|---|---|---|---|
| 5,496,431 | A | 3/1996 | Hirakawa et al. | |
| 6,092,452 | A | 7/2000 | Adami | |
| 6,103,171 | A | 8/2000 | Cummings | |
| 6,117,381 | A | 9/2000 | Cummings | |
| 6,893,520 | B2 * | 5/2005 | Cummings et al. | 156/64 |
| 2001/0047704 | A1 * | 12/2001 | Adami | 83/34 |
| 2004/0149378 | A1 * | 8/2004 | Cummings et al. | 156/250 |
| 2006/0090617 | A1 | 5/2006 | Cummings | |

FOREIGN PATENT DOCUMENTS

| | | |
|---|---|---|
| EP | 0 458 340 | 5/1991 |
| EP | 0 894 583 | 7/1998 |

* cited by examiner

*Primary Examiner*—Mark A Osele
*Assistant Examiner*—Christopher C Caillouet
(74) *Attorney, Agent, or Firm*—Andrus, Sceales, Starke & Sawall, LLP

(57) ABSTRACT

An order transition in a corrugated is accomplished by creating an overlap of the slits made by the slitting tools associated with the expiring (running) and new orders. However, the slit tool associated with the innermost slit between the upper and lower level outs is maintained in slitting contact with the board to extend the slit line into further overlap with the slits made by the new order tools to create an order change region. A lateral cut is made to connect the innermost slit between the upper and lower level outs on the new order and the slit created by the tool delayed from withdrawal in the running order. Trim cut transitions are handled in the same manner.

4 Claims, 6 Drawing Sheets

METHOD FOR ORDER TRANSITION ON A PLUNGE SLITTER

CROSS REFERENCE TO RELATED APPLICATION

This is a continuation-in-part patent application Ser. No. 11/243,279, filed Oct. 4, 2005.

BACKGROUND OF THE INVENTION

The present invention pertains to a system for facilitating an order change in the dry end conversion of a corrugated paperboard web. In particular, the invention relates to a method for maintaining web continuity on both levels of a double level dry end.

In a corrugator dry end, where a corrugated paperboard web is longitudinally scored and slit into multiple parallel output webs (or "outs"), the outs are directed through one or more downstream cutoff knives which cut the output webs into selected sheet lengths. When two cutoff knives are used, they are vertically separated and each is capable of cutting the full corrugator width web. A web selector positioned downstream of the slitter/scorer, divides the outs into two groups, one of which is directed to the upper cutoff knife and the other to the lower cutoff knife. Order changes must be effected while the upstream corrugated web end continues to produce and deliver the continuous web to the sitter/scorer. An order change will typically result in a change in widths of the output webs, requiring redirection of at least a central portion of the web from one knife level to the other and possibly changes in edge trim widths as well.

The prior art has developed two basic order change systems for corrugator dry ends utilizing double level cutoff knives. One system is known as a gapless or plunge style order change system. In this system, there are two slitter-sorer stations immediately adjacent one another in the direction of web movement and through both of which the web travels. At order change, one slitter/scorer, operating on the currently running order, will lift out of operative engagement with the web, and the other slitter/scorer which is set to the new order alignment plunges down into operative engagement with the web. The result is a small order change region of corrugated web with overlapping slits and scores for both the running and the new orders.

FIGS. 1-3 show different ways of sorting out the abutting slit lines to implement the order change. FIG. 1 shows a prior art order change according to European Patent 0 458 340 A2 involving an expiring (running) order with three slit webs $U_1$ going to the upper level of a cutoff knife and one slit web $L_1$ going to the lower level of the cutoff knife. The new order will have a single web $U_2$ going to the upper level and two slit webs $L_2$ going to the lower level. The order change is implemented by lateral cut $N_0$ made in the center of the web connecting the innermost slit $S_{14}$ between upper and lower level webs on the old order to the innermost slit $S_{22}$ between upper and lower levels webs on the new order. This allows web selectors to reset as the running order passes.

This order change strategy has at least two significant problems. First, it is very difficult in practice to have the tools creating the slit lines plunge into and out of the web abruptly at contact with lateral cut line $N_0$. Additionally, when the level transitioning from wide to narrow has outs narrower in width than the distance between the innermost slit line $S_{14}$ on the running order and the innermost slit line $S_{22}$ on the new order, one or more of the outs going to that level will be totally severed. This totally severed out can accelerate faster than its mating outs due to a slipping knife infeed pull roll. The totally severed out will then buckle and frequently jam in the knife.

FIG. 2 shows a different strategy for implementing the order changeover as disclosed in U.S. Pat. No. 5,496,431. This strategy involves creating an order change region that is formed between the front end of the new order sheets and the rear end of the running order sheets and creating a transitional slantwise slit, running at a predetermined angle with respect to the running direction of the continuous web, connecting the innermost slit between the upper and lower level webs in the running order to the innermost slit between the upper and lower level webs in the new order.

This order change method creates end of order waste that is of a different width and length from the expiring order outs. In addition, the pieces that are created when the waste goes through the cutoff knife may be small and angular shaped, creating potential for jam-up in the knife or at exit of the knife.

Yet another order change strategy, shown in FIG. 3, is disclosed in U.S. Pat. No. 6,092,452. With this strategy, an order change zone is created by lifting the slitting tools of the running order from the board line prior to plunging the tools of the new order into the board line. The concept then involves delaying the lift-up of one slitting tool associated with the innermost slit between the upper and lower levels of the running order and bringing forward the slitting tools associated with the innermost slit between the upper and lower knife levels of the new order into the order change zone. The effect of this is to create an overlap in the innermost slits on the running and new orders in the order change zone so that these slit lines can be connected by a lateral slit that may be perpendicular to the direction of forward travel of the web.

This order change method allows the connection of the slit lines defining the old and new orders with no severing of some of the outs going to the level with transition from wide to narrow outs. It avoids the problem of diagonal scrap pieces, but it also creates order change waste that is problematic. FIG. 4 shows waste removed from a stacker that was created on the upper and lower levels with this order change strategy. The waste is wider and longer than the sheets being discharged at the tail of the old order. As a consequence, the waste must be removed from the stacker transport conveyor prior to its entrance to the stacker or it will jam at the stacker bay. This is difficult for the stacker operator to accomplish and constitutes a large amount of waste sheet.

SUMMARY OF THE INVENTION

In accordance with the present invention, an order transition is accomplished by creating an overlap of the slits created by the tools associated with the expiring (running) and new orders. The slit tools associated with the running order are lifted from the board line after they create slits that established an overlap region with the slit lines made by the slit tools of the new order, except for the running order tool associated with the innermost slit between the upper and lower level outs. Lift-up of this slit tool is delayed, extending the slit line into further overlap with the slit lines created by the new order tools to create an order change region. A lateral cut is then made in the web generally perpendicular to the direction of board travel, connecting the innermost slit between the upper and lower level outs on the new order and the slit line created by the tool delayed from lifting out in the running order. This order transition strategy allows a continuous web to be maintained to both levels of the knife with no severing of one of the outs going to the level changing from wide to narrow, even if the width of those outs are narrower than the distance between the innermost slits on the running and new orders. The method of the present invention, when implemented with knife synchronization described in U.S. Pat. No. 6,893,520, will result in order change waste that is the same width as the outs of the expiring (running) order and shorter in length so that it can be discharged onto the top of the stack for subsequent removal by operators. No unusually-shaped pieces will be created that can jam the cutoff knife.

Edge trims are typically made along both outer edges of the web as it runs through the slitter. At order change, the edge trims also typically change and means must be provided for effecting the change in width of the trims at order change. The method of the present invention can also be utilized to accomplish these trim width changes. To achieve an effective change of trim widths, lift-up of the trim slit tools out of the running order is similarly delayed, thereby extending the trim slit lines into farther overlap with the trim slit lines created by the new order tools in the order change region.

DETAILED DESCRIPTION OF THE PREFERRED EMBODIMENT

Figure 1:
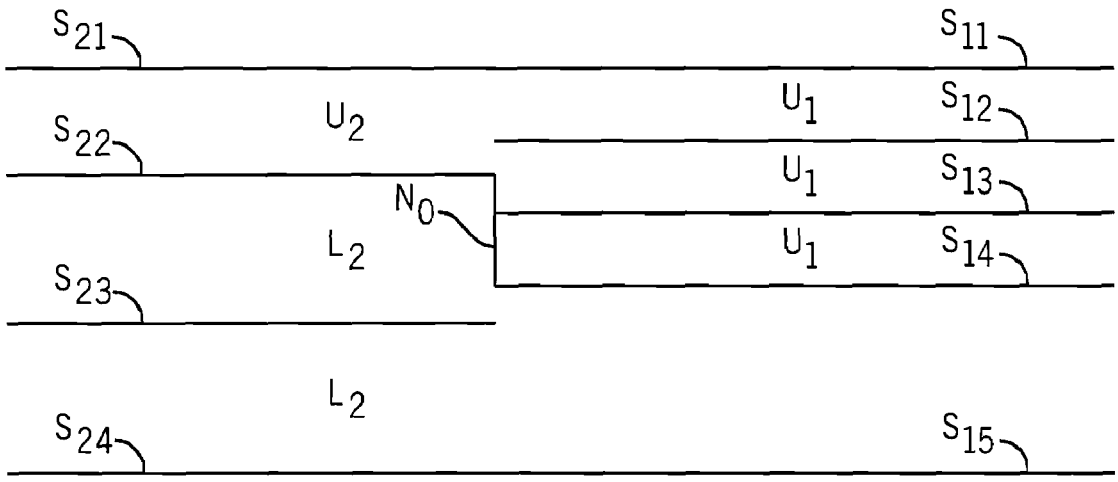
FIG. 1 is a schematic top view of the order change region of prior art technology.
Figure 2:
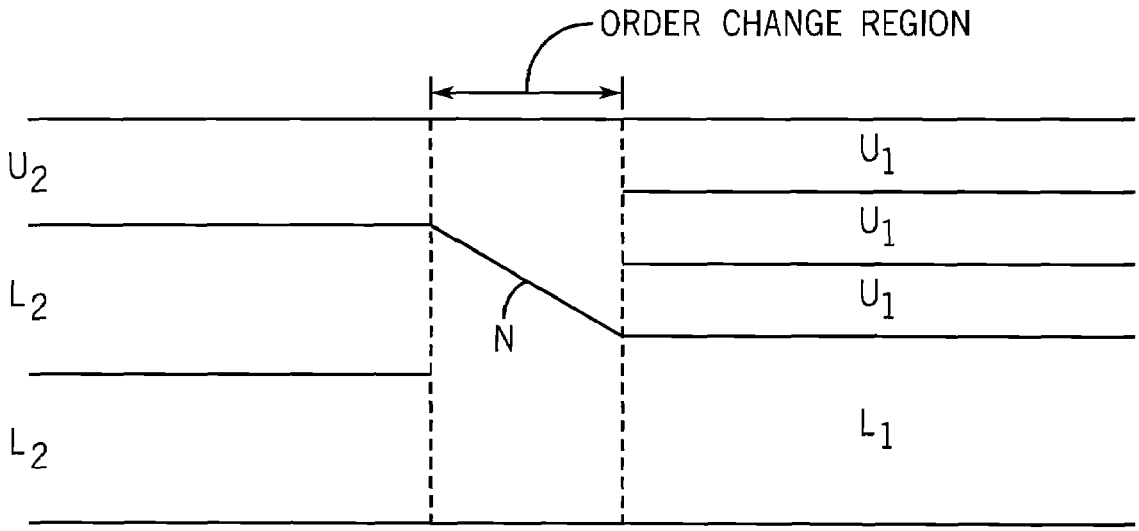
FIG. 2 is a schematic top view of the order change region of additional prior art technology.
Figure 3:
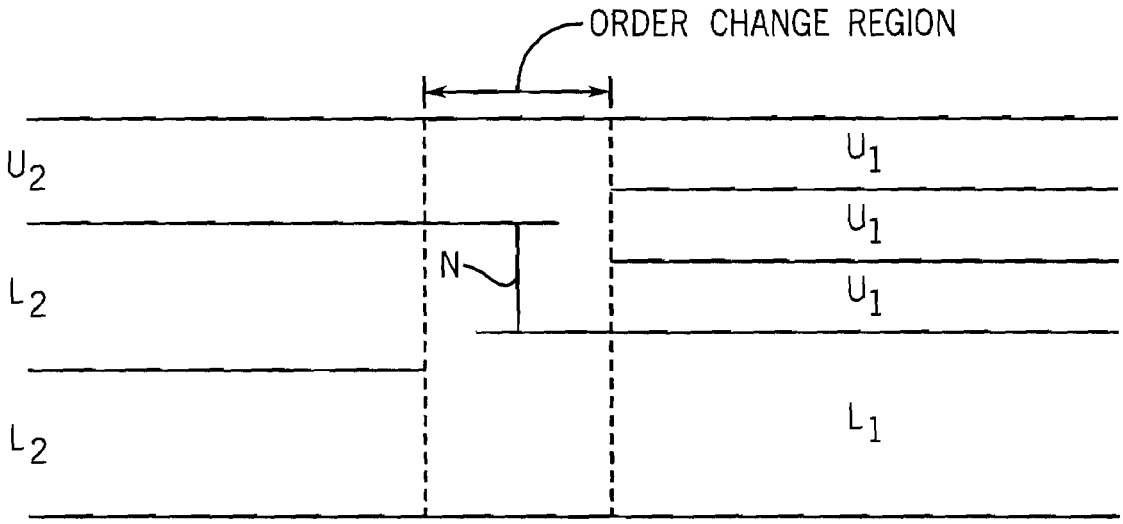
FIG. 3 is a schematic top view of the order change region of yet further prior art technology.
Figure 4:
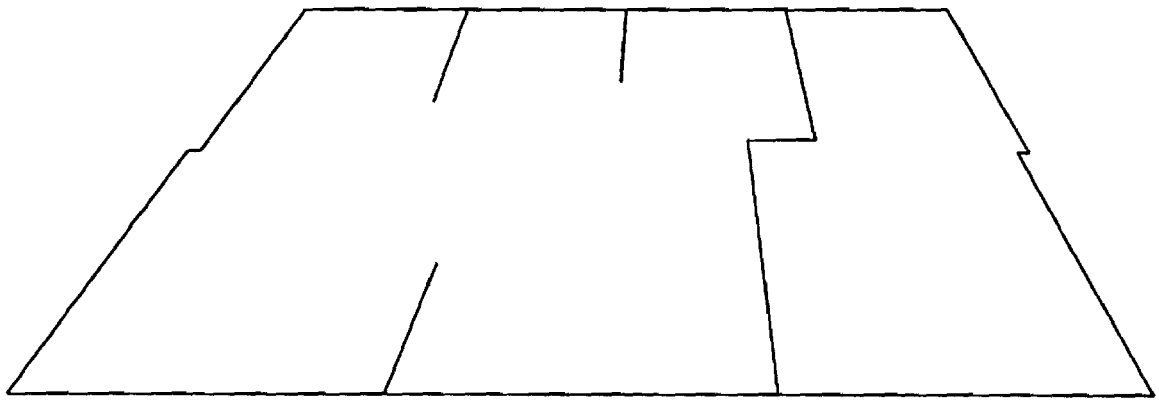
FIG. 4 is a perspective view of the waste sheet in and around the order change zone associated with an order change made using the technique of FIG. 3.
Figure 5:
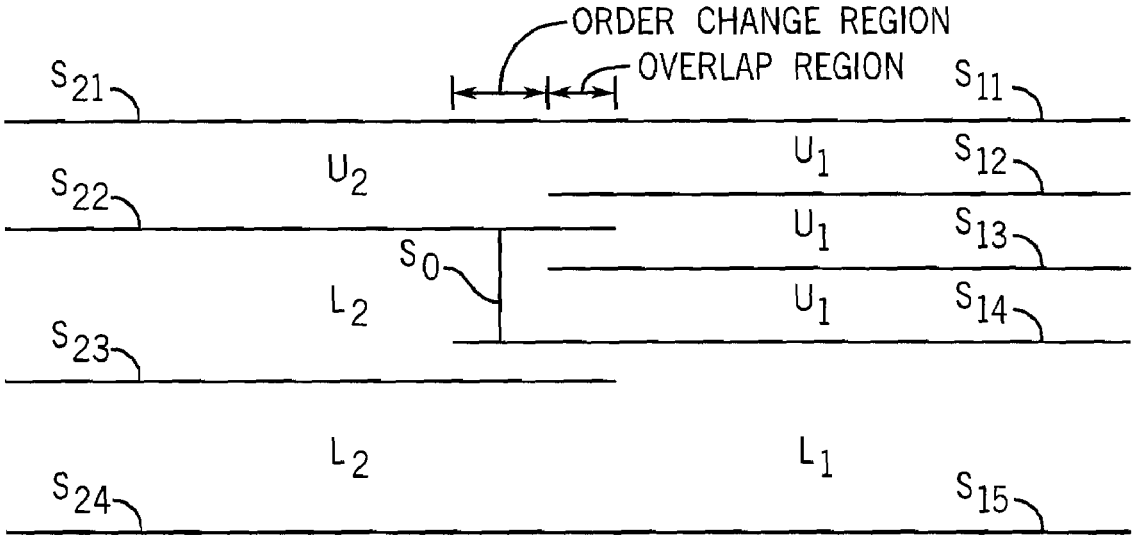
FIG. 5 is a schematic top view of the order change region of the present invention.

The present invention is described through a series of FIGS. 5-10. FIG. 5 shows a portion of a traveling web of corrugated board from the top view as it would appear after exit from a slitter/scorer. The slitter/scorer is of the tandem station variety with plunge slit axes. One station of the slitter/scorer would have slitting tools operatively engaged in the corrugated web for a running order, creating slit lines $S_{11}$-$S_{15}$ as shown in FIG. 5. The slit lines of this running order extend to an order change region, to be described, at the end of the order. The slitting tools of the other stations of the tandem slitter plunge into the board line, through the order change region, to extend beyond (in the downstream direction) the ends of the running order slit lines, and overlapping with the running order slit lines $S_{11}$-$S_{15}$ to create new order slit lines $S_{21}$-$S_{24}$.

The slit line $S_{14}$ of the running order comprising the innermost slit between the outs going to the upper level, $U_1$, and the outs going to the lower level, $L_1$, is extended by delaying the removal from the board line of the slitting tool creating this slit. By delaying the removal of this slit head, an order change region is created, upstream of the region of slit overlap, where it is possible to connect the slit line $S_{14}$ to the innermost slit $S_{22}$ between the upper level new order outs and the lower level outs using a perpendicular lateral cut $S_0$ in the web, without severing any of the outs going to the upper level on the running order $U_1$. This solves a critical problem as pointed out with respect to U.S. Pat. Nos. 5,496,431 and 6,092,452. As will be shown, there are advantages to this approach to order transfer related to minimizing waste at order change as well as improving operational reliability of the corrugated line by facilitating waste removal.

Figure 5A:
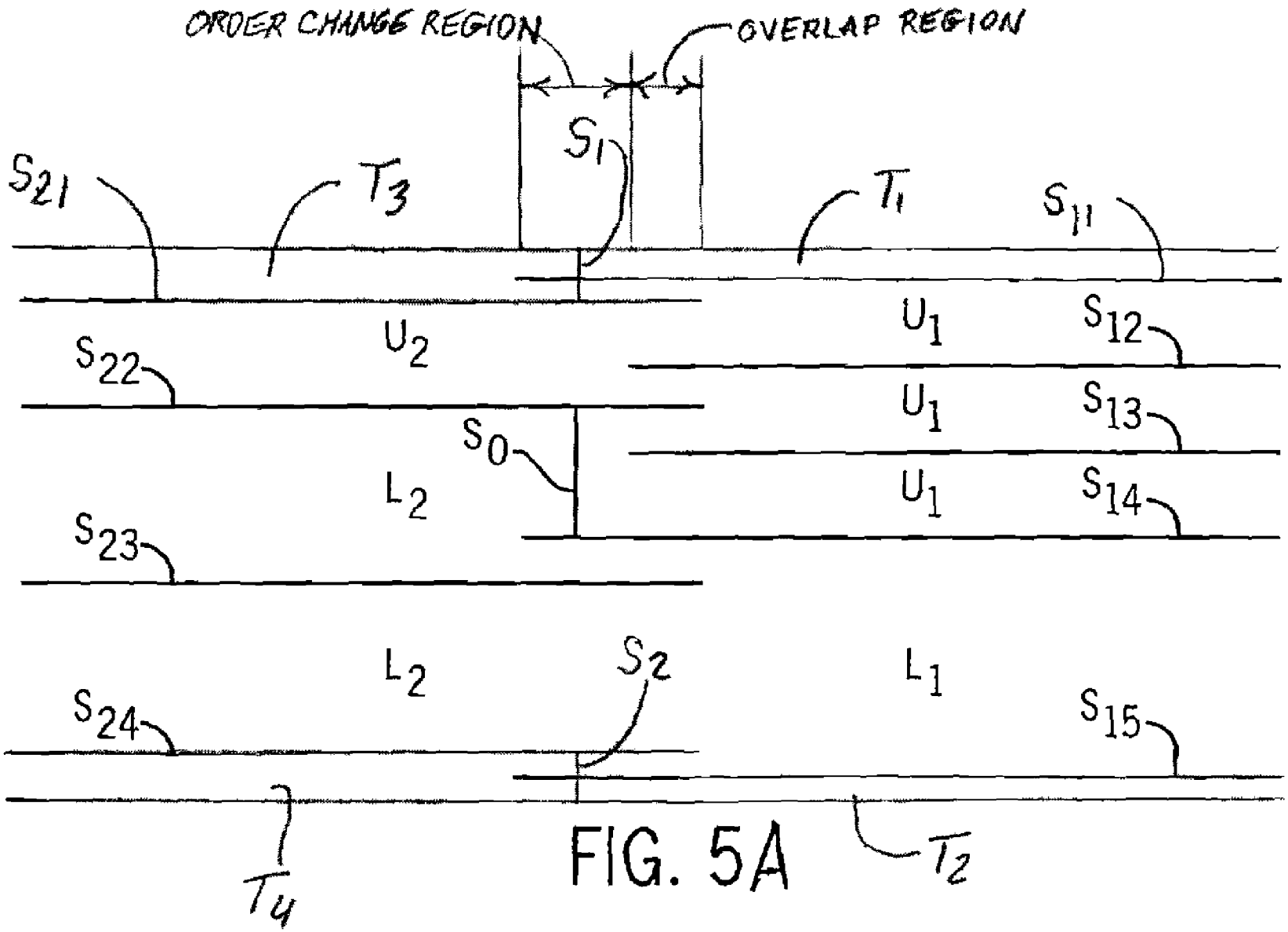
FIG. 5A is a schematic top view of the order change region, similar to FIG. 5, demonstrating how the order change method is applied to edge trim.

The method for accomplishing a trim width change in accordance with the present invention is shown in FIG. 5A. The web being processed is the same as the web in FIG. 5, however, the edge trims $T_1$ and $T_2$ for the running order and the edge trims $T_3$ and $T_4$ for the new order are shown. Because the edge trim widths between the running and new orders are different, accommodation must be made to permit the trim lines $S_{11}$ and $S_{15}$ of the running order to be changed to the new order trim lines $S_{21}$ and $S_{24}$, respectively. In a manner similar to the extension of the innermost slit $S_{14}$ into the order change region, the trim slit lines $S_{11}$ and $S_{15}$ of the running order are extended into the order change region. This permits perpendicular lateral cuts $S_1$ and $S_2$ across the trim slit lines to allow change in trim widths to be accommodated. The perpendicular lateral cuts $S_1$ and $S_2$ can be made using the same cutting device and with similar timing as the device used to make the main lateral cut $S_0$. Alternately, an independent cutting device, activated in the order change region, can be used.

Figure 6:
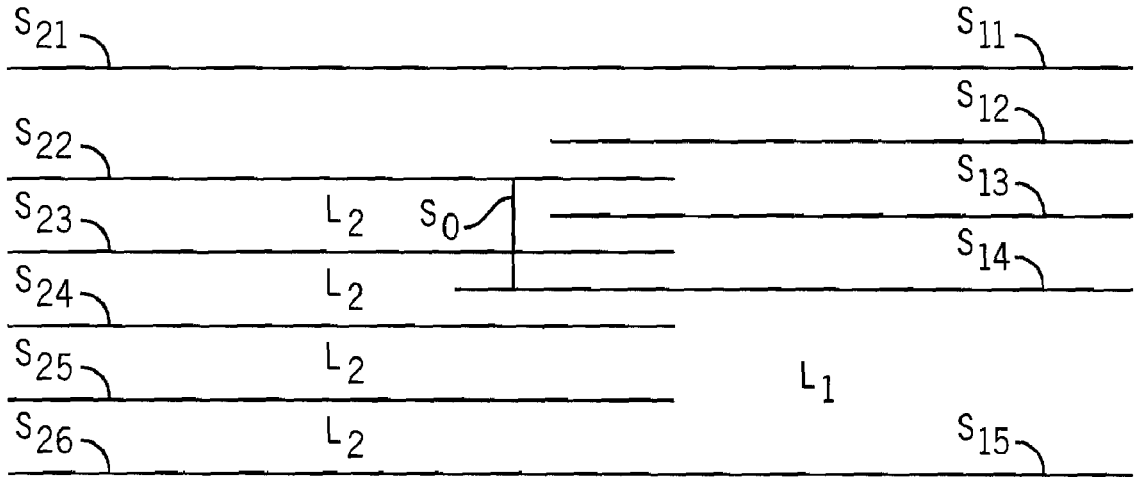
FIG. 6 is a schematic top view of the order change region of the present invention showing a special case of narrow webs in the new order.

A special case of application of the present invention is shown in FIG. 6. In this case, the outs $L_2$ on the new order, on the level in which the total width of the outs is transitioning from narrow to wide (i.e. the lower level L), are narrower in width than the distance between the innermost slits on the new and running orders. In this case, the delayed slit head removal of running order slit head $S_{14}$ and the connection of the innermost slits on the new order $S_{22}$ to the innermost slit on the running order $S_{14}$ with lateral slit $S_0$ perpendicular to the direction of board travel, will cause the new order out to the lower level $L_2$, created by slits $S_{22}$ and $S_{23}$, to be totally severed. This is normally not a significant problem. The majority of prior art slitters using a gap-style order change have all of the outs severed at order change. Although the continuous concept is now regarded as superior in eliminating jam-up at order change, the probability of jam-up of a single severed out on the new order is very small. Indeed, the frequency of occurrence of this situation is normally quite low. On the other hand, having one of the webs on the running order severed while the adjoining outs are not is a serious problem likely to create a jam-up with high probability. Delaying the end position of the innermost slit of the running order solves this problem.

Figure 7:
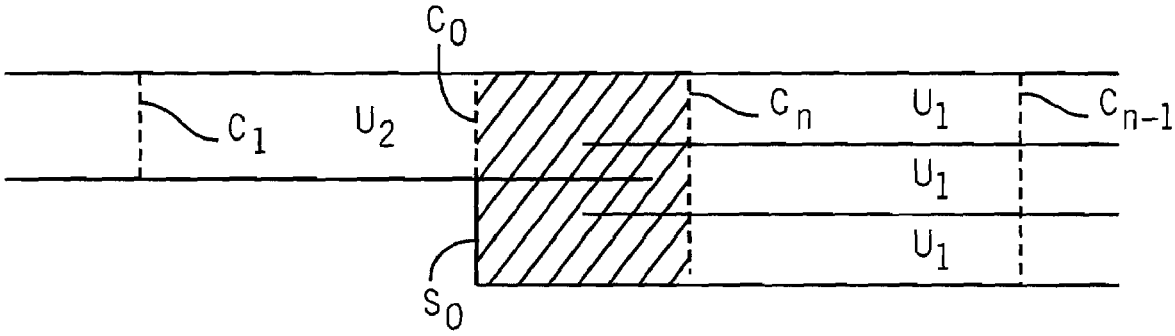
FIG. 7 is a schematic top view of the top level of the web of FIG. 5 showing how knife cuts define the waste at order change.

There are substantial benefits associated with the present invention in terms of minimizing problems with order change waste. FIG. 7 shows a top view of the top portion of the order of FIG. 5 as it would appear proceeding through the cutoff knife. The lateral cut line $C_{N-1}$ is the second last cut in the old order at the knife. The cut $C_N$ is the last cut creating a good sheet at the end of the old order. Cut $C_0$ is synchronized to cut on the wide to narrow order transition line $S_0$. This is accomplished using the method and apparatus as described in U.S. Pat. No. 6,893,520. The benefit of the present invention, in conjunction with this '520 patent invention, is the creation of scrap pieces that can be minimized in length according to the procedures described in the '520 patent and of a format that will always be of a width such that the scrap pieces can fit into the top of the stack discharged from the stacker bay. Alternatively, this well-conditioned scrap sheet could be diverted using the apparatus according to this invention shown in FIG. 9.

Figure 8:
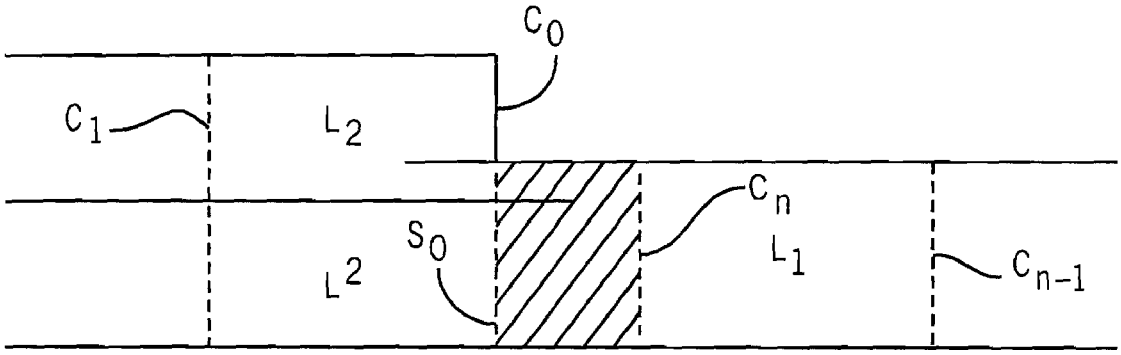
FIG. 8 is a schematic top view of the lower level of the web of FIG. 5 showing how knife cuts define the waste at order change.

FIG. 8 shows a top view of the bottom portion of the order of FIG. 5 as it would appear proceeding through the cutoff knife. The lateral cut $C_{N-1}$ would be the second to last cut in the running order on the lower level. The cut $C_N$ is the last cut creating a good sheet of the end of the running order. Cut $C_0$ is synchronized to cut lined up with the narrow to wide transition line $S_0$ using the method and apparatus of U.S. Pat. No. 6,893,520. Again, the scrap sheet shown in cross-hatched line can be minimized in length and is exactly the same width of the expired order so that it can fit onto the top of the stack discharged.

Figure 9:
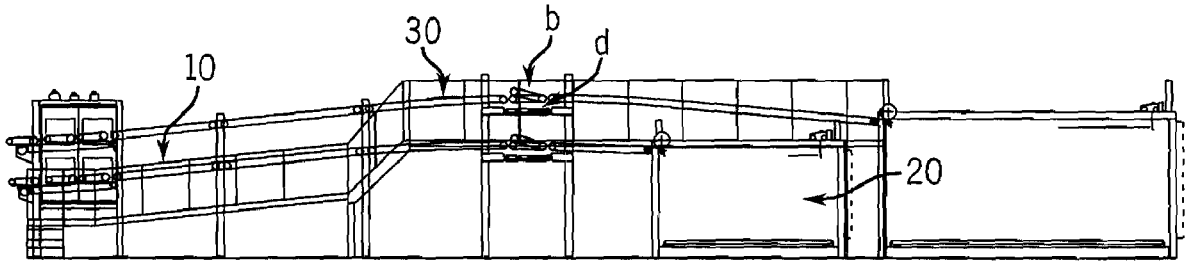
FIG. 9 is a schematic side view of a stacker with scrap sheet diverter.
Figure 10:
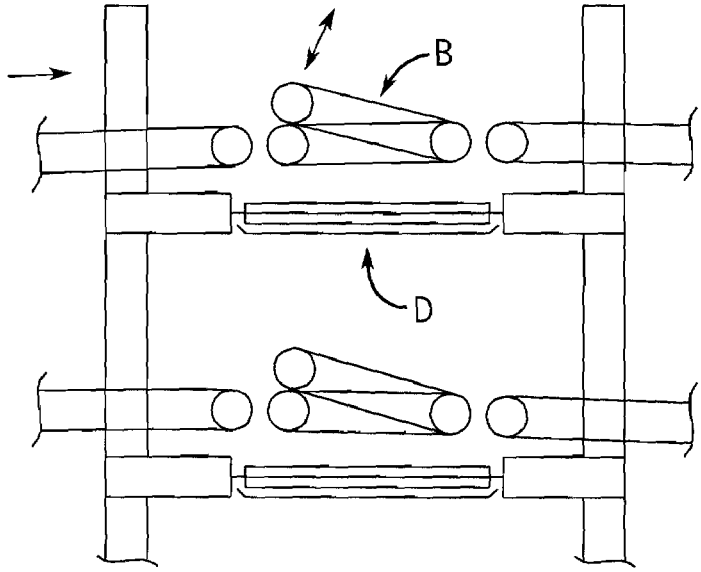
FIG. 10 is a schematic side view of a stacker with scrap sheet diverter.

A schematic of the cutoff knife and downstacker is shown in FIG. 9. The stacker transport system 10 conveys the shingled sheets from the orders to the stacker bays 20. The scrap piece from the order change 30 can be segregated in the transport conveyors 10 using well known speed switching techniques and diverted onto scrap discharge conveyor(s) $d_1$ using scrap diverter $b_1$ on both the top and bottom levels. A close-up of the stacker diverter is shown in FIG. 10.

What is claimed is:

1. A method for minimizing scrap in a gapless order change for a corrugator, said corrugator including a plunge slitter having multiple slitting tools, including interior slitting tools and edge trim slit tools, each operable to be moved vertically into slitting engagement with a continuous corrugated paperboard web at the start of a new order to provide longitudinal slit lines in the web, the slit lines dividing the web into a plurality of output webs of selected widths, said slitting tools operable to be moved vertically out of slitting engagement with the web at the end of a running order, a pair of vertically separated cut-off knives downstream of the slitter for receiving and cutting the output webs into selected sheet lengths, said knives including an upper knife and a lower knife, and a web selector device between the slitter and the cut-off knives for selectively separating the output webs along a common innermost slit line into an upper output web portion and a lower output web portion for said respective upper knife and lower knife, said method comprising the steps of:

(1) operating the slitter to start a new order while continuing to slit the running order to create an overlap region in the web where all running order and new order slits overlap;

(2) maintaining the slitting tool for the common innermost slit line of the running order in slitting engagement with the web for a selected distance beyond the overlap region to define with the new order slit lines an order change region upstream of and outside the overlap region;

(3) maintaining the edge trim slit tools of the running order in slitting engagement with the web for a selected distance beyond the overlap region and into the order change region;

(4) partially severing the web upstream of the web selector device to provide a generally transverse slit in the order change region to connect the common innermost slit line of the running order web portions and the common innermost slit line of the new order output web portions; and, (5) severing the web upstream of the web selector device from the innermost edge trim slit line of the running and new orders laterally to the edge of the web on both sides.

2. The method as set forth in claim 1 comprising the steps of:

(1) after separating the output web portions, sensing a transverse edge of a web portion defined by said transverse slit and generating an edge location signal; and, (2) operating one of the cutoff knives in response to said transverse edge location signal to cut one of the web portions on the line of said transverse slit.

3. The method as set forth in claim 2 wherein the step of partially severing the web comprises slitting the web intermediate the opposite edges of the web.

4. The method as set forth in claim 3 including the steps of:

(1) sensing a transverse edge of the other web portion defined by said transverse slit and generating a second edge location signal; and, (2) operating the other cut-off knife in response to said second edge location signal to cut said other web portion on the line of said transverse slit.

* * * * *